US010781035B2

(12) United States Patent
Jakus

(10) Patent No.: US 10,781,035 B2
(45) Date of Patent: Sep. 22, 2020

(54) FOLDED PACKAGED GLOVES

(71) Applicant: Ansell Limited, Richmond, Victoria (AU)

(72) Inventor: Mario Anthony Jakus, Saddle Brook, NJ (US)

(73) Assignee: Ansell Limited, Victoria (AU)

( * ) Notice: Subject to any disclaimer, the term of this patent is extended or adjusted under 35 U.S.C. 154(b) by 542 days.

(21) Appl. No.: 14/260,825

(22) Filed: Apr. 24, 2014

(65) Prior Publication Data

US 2015/0307263 A1 Oct. 29, 2015

(51) Int. Cl.

| | |
|---|---|
| ***A41D 19/00*** | (2006.01) |
| ***B65D 85/18*** | (2006.01) |
| ***G07F 11/38*** | (2006.01) |
| ***B65D 77/04*** | (2006.01) |

(52) U.S. Cl.

CPC ..... *B65D 85/18* (2013.01); *A41D 19/0051* (2013.01); *B65D 77/04* (2013.01); *G07F 11/38* (2013.01); *B65D 2577/043* (2013.01)

(58) Field of Classification Search

CPC ..... A41D 19/0051; A41D 19/0055; A41D 19/045; A61B 2019/027; B65D 77/04; B65D 85/18

See application file for complete search history.

(56) References Cited

U.S. PATENT DOCUMENTS

| | | | | | |
|---|---|---|---|---|---|
| 2,893,546 | A | * | 7/1959 | Kendall et al. | 206/278 |
| 3,286,831 | A | * | 11/1966 | Giberstein | 206/278 |
| 4,094,120 | A | * | 6/1978 | Goncalves | B65D 75/04 53/429 |
| 4,186,955 | A | * | 2/1980 | Campbell | 294/1.3 |
| 4,951,815 | A | * | 8/1990 | Ulbrich | 206/213 |
| 5,044,493 | A | * | 9/1991 | Crawford et al. | 206/293 |
| D365,670 | S | * | 12/1995 | Walker | D32/40 |
| 5,522,499 | A | * | 6/1996 | DeBiasio et al. | 206/278 |
| 5,740,943 | A | * | 4/1998 | Shields et al. | 221/33 |
| 5,816,440 | A | * | 10/1998 | Shields et al. | 221/45 |

(Continued)

FOREIGN PATENT DOCUMENTS

| | | |
|---|---|---|
| GB | 2489326 A | 9/2012 |
| WO | WO-2010086645 A1 | 8/2010 |

OTHER PUBLICATIONS

"Hand Specific Glove Dispenser", Safety Inc., 2011. Downloaded from website http://www.esafetyinc.com/store/product.cfm?pID=7C514B4D48187555, 1 page.

(Continued)

*Primary Examiner* — Gene O Crawford
*Assistant Examiner* — Kelvin L Randall, Jr.
(74) *Attorney, Agent, or Firm* — Moser Taboada

(57) ABSTRACT

A package of at least one glove pair, comprising a right glove and a left glove, wherein at least one glove has an indicia comprising at least one of a logo, a manufacturer's name, or usage information of the glove displayed thereon, wherein the right glove and the left glove are folded in a multi-fold configuration. At least partially transparent first packaging encases the right glove and the left glove, and maintains the multi-fold configuration, wherein the indicia of at least one of the right glove or the left glove is visible through the first packaging while folded.

11 Claims, 13 Drawing Sheets

(56) References Cited

U.S. PATENT DOCUMENTS 5,878,909 A 3/1999 Rogow
5,934,462 A * 8/1999 Gregory ..... B65D 75/42 206/278
6,062,421 A 5/2000 Marley
6,095,326 A * 8/2000 Madhat ..... B65D 83/0805 206/233
6,415,949 B1 * 7/2002 Tramontina ..... A47K 10/424 221/45
6,543,642 B1 * 4/2003 Milliorn ..... B65D 77/06 206/438
6,625,816 B1 * 9/2003 Cooke ..... 2/161.5
7,380,289 B2 * 6/2008 Kordecki et al. ..... 2/163
7,699,189 B2 * 4/2010 Tramontina ..... 221/36
7,939,159 B2 * 5/2011 Hochtritt ..... A47K 10/42 428/126
8,132,692 B2 * 3/2012 Jordan ..... 221/197
8,684,226 B2 * 4/2014 Lien ..... 221/45
2002/0060221 A1 * 5/2002 Grinberg ..... A41D 19/0072 221/27
2003/0057222 A1 * 3/2003 Milliorn ..... 221/46
2003/0201276 A1 * 10/2003 Fuller ..... 221/155
2004/0182876 A1 * 9/2004 Lennox ..... 221/92
2004/0245269 A1 * 12/2004 Grinberg ..... 221/38
2007/0108075 A1 * 5/2007 Withers ..... B65D 85/18 206/299
2007/0215497 A1 * 9/2007 Reddy et al. ..... 206/278
2008/0277405 A1 * 11/2008 Leach et al. ..... 221/1
2010/0055391 A1 * 3/2010 Penfield ..... A47G 11/001 428/126
2011/0062179 A1 * 3/2011 Stollery et al. ..... 221/45
2012/0124714 A1 * 5/2012 Hamann ..... 2/168
2012/0160865 A1 * 6/2012 Lien ..... 221/45
2013/0186787 A1 7/2013 Yao et al.
2015/0034510 A1 * 2/2015 Crane ..... 206/278
2015/0232216 A1 * 8/2015 Stollery ..... B65B 25/20 53/436
2016/0152403 A1 * 6/2016 Ray ..... B65D 83/0894 221/1
2020/0002080 A1 * 1/2020 Robert ..... B65D 83/0805

OTHER PUBLICATIONS

Akridge, "Gearing up for safety dance", Healthcare Purchasing News, Jul. 2013. Downloaded from website http://www.hpnonline.com/inside/2013-07/1307-IP-PPE.html, 10 pages.

* cited by examiner

FOLDED PACKAGED GLOVES

BACKGROUND

Field of the Invention

Embodiments of the present invention generally relate to gloves. More specifically, embodiments of the invention relate to packaged gloves comprising two or more folds.

Description of the Related Art

Gloves, including supported and unsupported gloves, are used in many industries, such as construction, industrial, and medical, as well as households, to protect the hands of users. Such gloves are being manufactured and specified for narrowly defined uses. In other words, gloves have become specialized, i.e., specifically manufactured and sold for a certain physical property, or service application. For example, some gloves are specified for cut-resistance, while others are specified for an enhanced grip. Moreover, different industries have different standards. For example, a glove having a certain feature, such as a cut-resistant supported glove having a polymeric coating, might not be permissible in a food service setting because of the flaking of the coating, while a cut-resistant glove for a welder needs a flame-resistant coating. Further, as gloves have become specialized and in many cases, more expensive, consumers want to ensure that they obtain the correct glove prior to purchase.

Identifying the correct glove, for example, in industrial environments which may stock several types of gloves having different features for different applications, is a non-trivial unsolved problem. For example, gloves are often folded in one orientation and re-folded in a different orientation for packaging, obscuring the branding information of the glove or information identifying the properties of the glove. Also, gloves are sometimes folded inside each other, such as when one cuff is turned inside out, with one glove enveloping a mating glove, which also obscures identifying marks of the glove unless such marks were placed on the interior of the glove, which, therefore, is not a favored solution. Placing marks on the interior would be disadvantageous because in such instances, the marks would not be visible while a glove is worn.

Further, many gloves are now distributed using vending machines, and if indicia of the properties is not present or prominently visible on the gloves, the chance of user confusion is increased. Such confusion be detrimental to sales of gloves, or may lead to a user selecting and using the wrong glove for a particular task. Significantly, the use of gloves not indicated for a specific purpose increases the likelihood of injury. Also, gloves need to be folded and packaged efficiently, in order to utilize vending machine space efficiently, and not jam in the vending machine, i.e., to hold as many units as possible in correct orientation within the vending machine. Therefore, packaging gloves so that, for example, a logo or a brand, as well as other identifying information, is clearly displayed while folded represents an advance in the art.

SUMMARY

Multi-folded, individually packaged gloves, substantially as shown in and/or described in connection with at least one of the figures, as set forth more completely in the claims, are disclosed. Various advantages, aspects, and novel features of the present disclosure, as well as details of an exemplary embodiment thereof, will be more fully understood from the following description and drawings.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings and disclosure depict exemplary embodiments of the invention and are therefore not to be considered limiting of the scope of the particular forms described, for those skilled in the art will recognize additional embodiments of the present invention, which covers all modifications, equivalents, and alternatives within the spirit and scope of the present invention as defined by the appended claims.

Figure 1A:
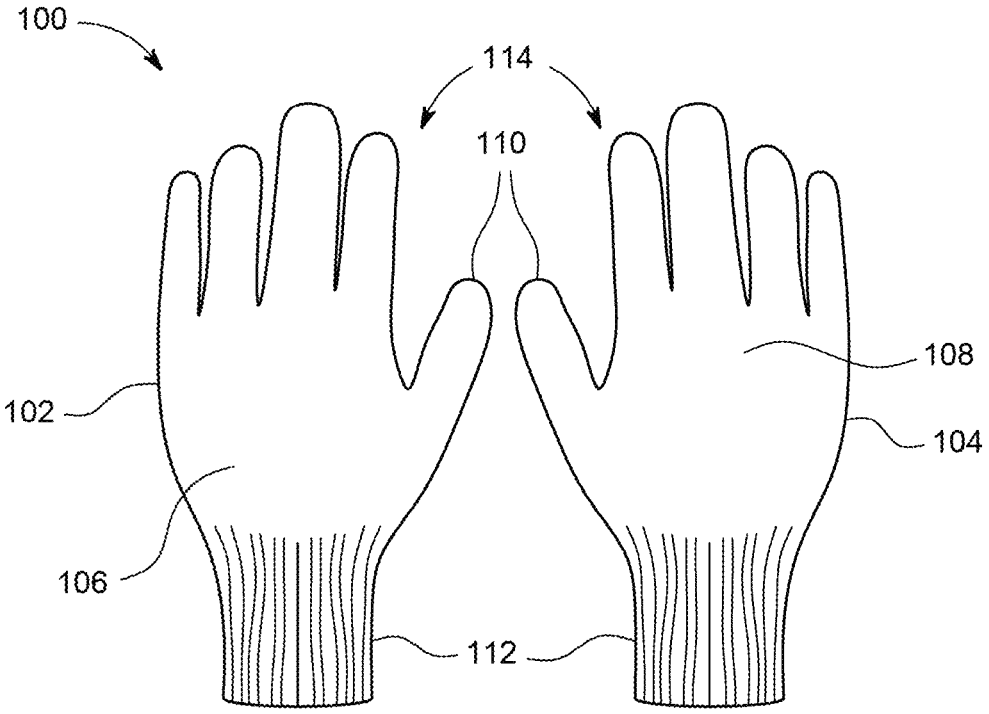
FIGS. 1A-1H depict a pair of gloves tri-folded for packaging, according to embodiments of the invention.

The headings used herein are for organizational purposes only and are not meant to be used to limit the scope of the description or embodiments according to the invention. As used throughout this application, the word "may" is used in a permissive sense, meaning having the potential to, rather than the mandatory sense. Similarly, the words "include," "including," and "includes" mean including, but not limited to.

DETAILED DESCRIPTION

Embodiments according to the present invention include individually packaged gloves, which are folded in various manners, for example, a pair of gloves that is tri-folded along a longitudinal axis. Gloves include fabric gloves, supported gloves, i.e., gloves comprising a fabric liner having a coating disposed thereon, or unsupported gloves. All gloves, supported, unsupported, knitted, woven, cut-and-sewn gloves, and the like are contemplated as being within the scope of the invention. The gloves according to embodiments of the invention may be tri-folded so that fingers are folded over palm of the glove, and cuff is folded over the fingers, or vice versa, also called a roll fold. Alternatively, the gloves may be folded in a Z-fold configuration, in which the fingers are folded over the palm of the glove, and the cuff is folded over a backhand side of the glove. According to several embodiments, a left glove and a right glove are folded and packaged together as a pair of gloves. The gloves pairs may be configured to have corresponding palms facing each other such that the backhand sides of each of the left glove and the right glove face outwards. In some configurations, a palm of a left glove faces a backhand side of a right glove, such that the backhand side of the left glove faces outwards, or vice versa. In some configurations, the thumbs are folded over respective palm or backhand. In each configuration, the profile of the left and the right gloves substantially overlap to enable substantially uniformly shaped layers of gloves for folding. Previously discussed folding configurations, for example, a roll fold or a Z-shaped fold can be applied similarly to the pair of gloves, for example, by ensuring that at least one backhand side of the glove faces outward such that at least a substantial part of the indicia on the backhand side is visible when the glove pair is folded.

The gloves are folded and packaged so that one or more indicia including type, brand, industry-application, or manufacturer can be easily viewed by a consumer prior to purchase. The folding and packaging as described with respect to some embodiments herein ensures that at least one of such indicia is easily and completely visible to a user purchasing gloves from a vending machine, for example. The user can select the appropriate product using the indicia. Moreover, there may be legal reasons why it is important to display certain information. For example, a patent number may be printed on a glove conspicuously so that one who would sell or import the glove into the U.S. might see such indicia. In several cases, the English name of the country of origin of the glove is required to be clearly visible on the glove.

Figure 1B:
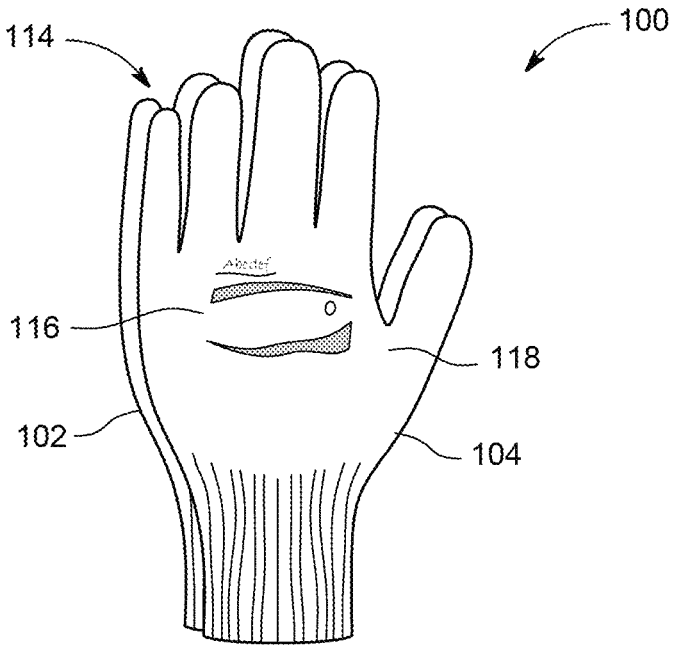
Figure 1C:
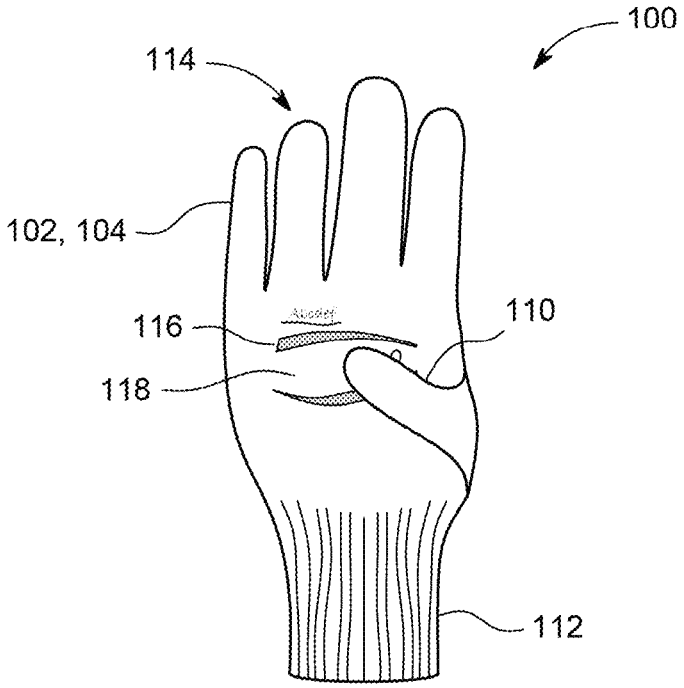
Figure 1D:
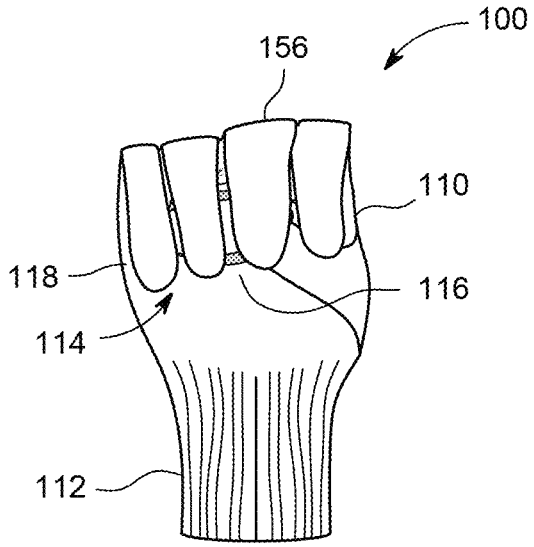

FIGS. 1A-1H depict a pair of gloves 100 tri-folded for packaging, according to embodiments of the invention. FIG. 1A depicts the pair of gloves 100 or the glove pair 100, comprising a right hand glove 102 or a right glove 102, a left hand glove 104 or a left glove 104, each having a palm 106, and 108 respectively. The left glove 102 and the right glove 104 comprise left and right thumbs, referred to as thumb(s) 110, left and right cuffs, referred to as cuff(s) 112, and left and right set of fingers, referred to as finger(s) 114. FIG. 1B depicts the glove pair 100 comprising the right and left gloves 102, 104 configured in a mirror configuration such that the corresponding palms 106, 108 contact each other. FIG. 1B depicts the gloves 102, 104 offset from each other for illustration purposes, and as such, it is intended that the right glove 102 completely overlaps the left glove 104, or vice versa. The left glove 104 has a backhand side 118, while the right glove 102 has a corresponding backhand side 120 (not visible in FIG. 1B). The backhand sides 118, 120 comprise one or more indicia 116 for identifying application, branding, size and other such information. The indicia 116 of one or either backhands 118, 120 are collectively referred to as the indicia 116, and includes, without limitation, a logo, a manufacturer's name, or usage information, such as functionality, e.g. cut-resistance, of the gloves 102, 104, for example. FIG. 1C depicts the glove pair 100 comprising the right and the left gloves 102, 104 overlapping each other completely, and the thumbs 110 folded over the backhand 118 of the left glove 104. FIG. 1D depicts the glove pair 100 with the fingers 114 folded over the backhand 118 and the thumbs 110. The fold of the fingers 114 defines a folded edge 156 or a finger side edge 156.

Figure 1E:
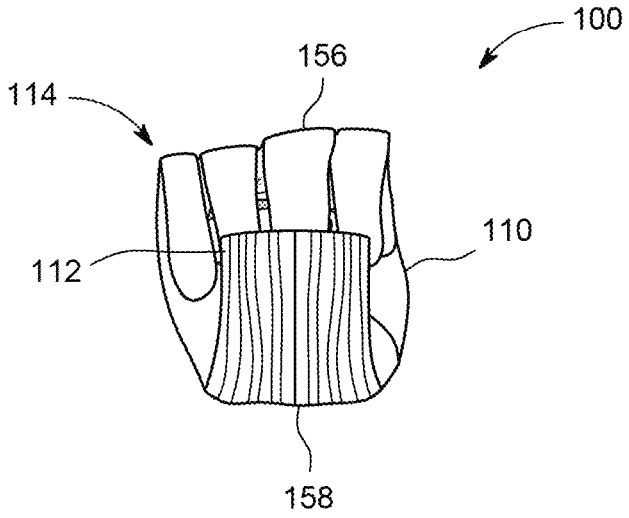
Figure 1F:
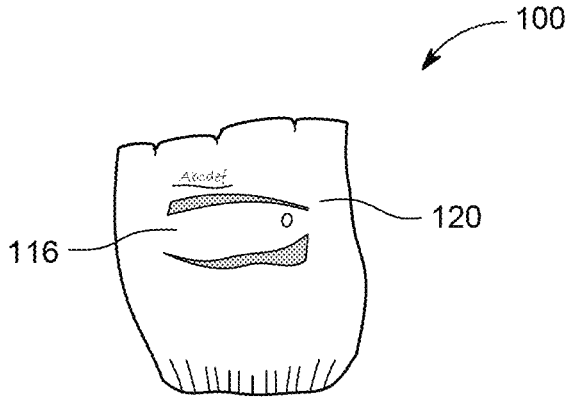

FIG. 1E depicts a roll fold of the glove pair 100. The cuffs 112 are folded over the fingers 114, and the fold of the cuffs 112 defines an edge 158 or a cuff side edge 158. FIG. 1F depicts a back view of the roll folded glove pair 100 of FIG. 1E, in which the backhand 120 portion of the right glove 102 and indicia 116 thereon is completely visible.

Figure 1G:
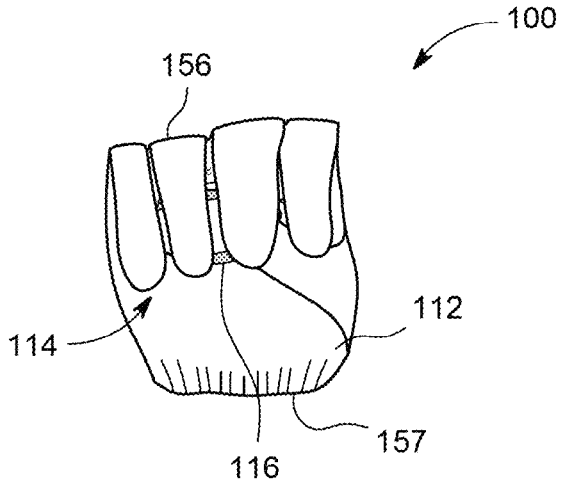
Figure 1H:
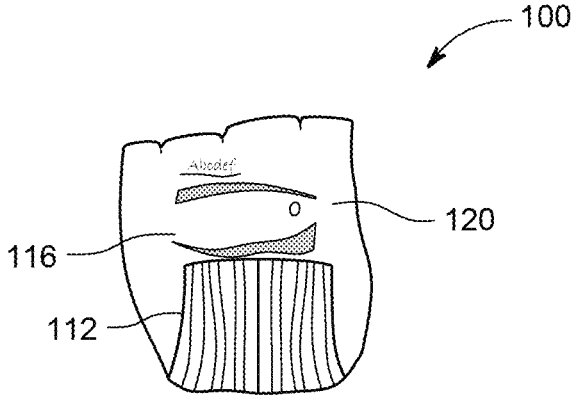

FIG. 1G depicts a Z-shaped fold of the glove pair 100. The cuffs 112 are folded over the backhand 120 of the right glove 102, and the fold of the cuffs 112 defines an edge 157 or a cuff side edge 157. The backhand 118 is partially covered by the fingers 114, and the indicia 116 thereon, is at least partially visible. FIG. 1H depicts a back view of the Z-shaped folded glove pair 100 of FIG. 1G, in which the backhand 120 of the right glove 102 is completely visible. It is noted that in the Z-shaped fold, the backhand 120 is partially covered by the cuffs, the backhand 120 and any indicia thereon, is still completely visible.

In several multi-folded configurations, for example, tri-fold configurations such as the roll fold and the Z-shaped fold, and quad-fold configurations, the right glove 102 and the left glove 104 are folded together in a substantially overlapping configuration, and a substantial portion of the backhand 120 and the indicia 116 thereon is visible when the glove pair 100 is folded in the abovementioned configurations. According to some embodiments, the indicia 116 of at least one of the right glove 102 or the left glove is 104 is completely visible in a folded configuration. According to some embodiments, the indicia 116 of each of the right glove 102 and the left glove 104 is at least partially visible in a folded configuration. Further, in the aforesaid configurations, the left and the right gloves 102, 104 are nested, that is, the left and the right gloves are not individually separable while folded. In some embodiments (not shown), the right glove 102 and the left glove 104 are folded individually, and the gloves 102, 104 are therefore individually separable while folded.

Figure 2A:
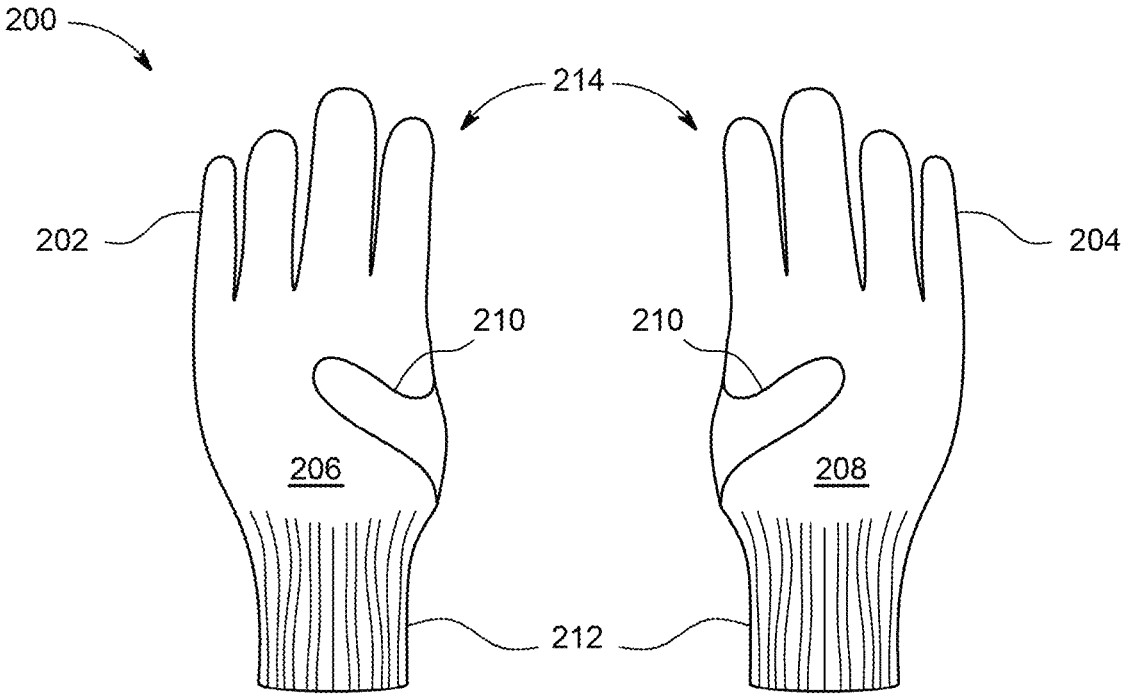
FIGS. 2A-2D depict a pair of gloves quad-folded for packaging, according to embodiments of the invention.
Figure 2B:
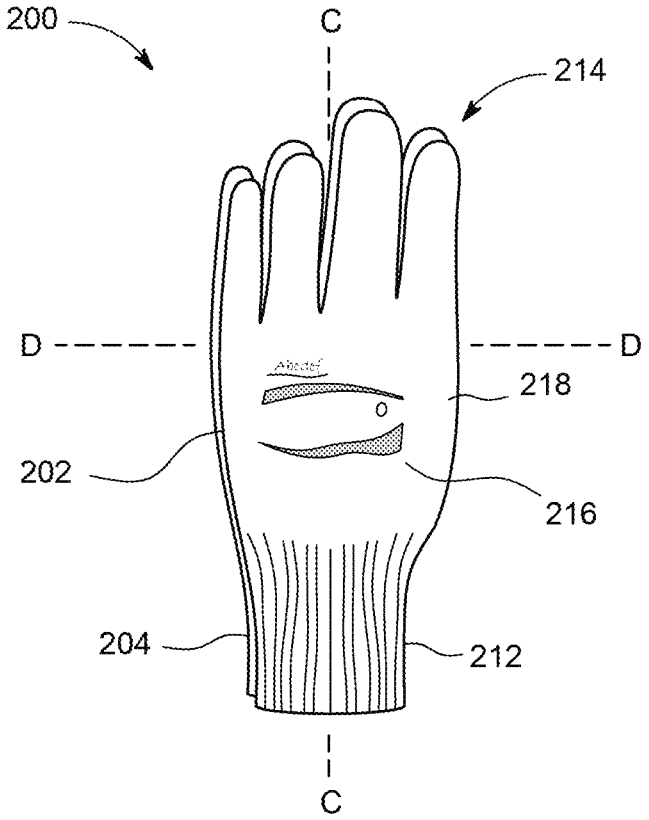
Figure 2C:
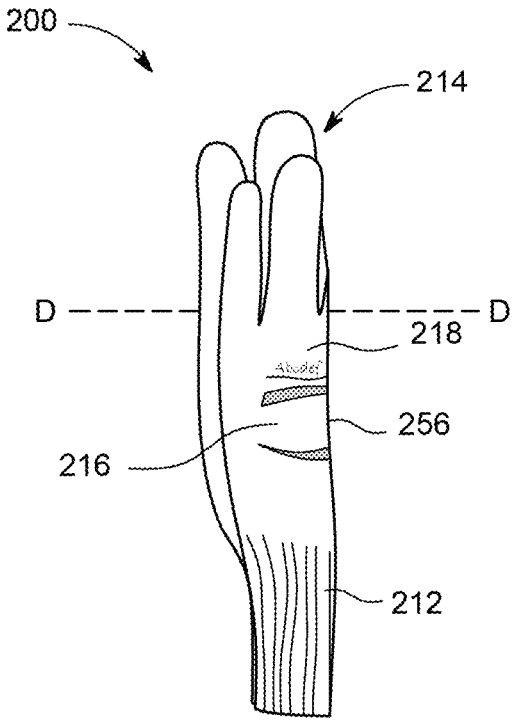
Figure 2D:
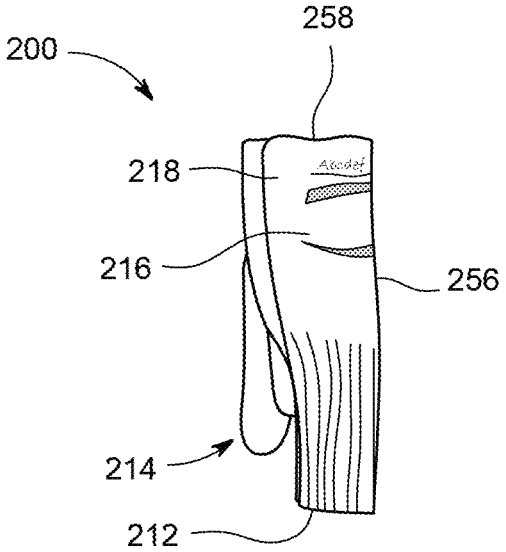

FIGS. 2A-2D depict a pair of gloves 200 quad-folded for packaging, according to embodiments of the invention. FIG. 2A depicts the pair 200 of gloves or the glove pair 200, comprising a right glove 202 or a right glove 202, a left glove 204 or a left glove 204, each having a palm 206, and 208 respectively. The left glove 202 and the right glove 204 comprise left and right thumbs, referred to as thumb(s) 210, left and right cuffs, referred to as cuff(s) 212, and left and right set of fingers, referred to as finger(s) 214. Each of the thumbs 210 is individually folded over the respective palms 206, 208. FIG. 2B depicts the glove pair 200 comprising the right and left gloves 202, 204 configured in a mirror configuration such that the corresponding palms 206, 208 contact each other. The glove pair 200 comprises a longitudinal axis C-C and a lateral axis D-D. FIG. 2B depicts the gloves 202, 204 offset from each other for illustration purposes, and as such, it is intended that the right glove 202 completely overlaps the left glove 204, or vice versa. The left glove 204 has a backhand side 218, while the right glove 202 has a corresponding backhand side (not shown). The backhand sides comprise one or more indicia 216 for identifying application, branding, size and other such information. The indicia 216 of one or either backhands are collectively referred to as the indicia 216. FIG. 2C depicts the glove pair 200 folded in half along the longitudinal axis C-C of the glove pair 200 extending in a direction from the cuffs 212 towards the fingers 214, defining an edge 256 or a central fold 256. FIG. 2D depicts the glove pair 200 further folded along the lateral axis D-D, such that the fingers 214 extend to meet the cuffs 212, and the fingers 214 substantially overlap the cuffs 212, and vice versa. Such folding configuration is also referred to as a quarter fold. A substantial portion of the backhand 218 and any indicia thereon is visible when the glove pair 200 is folded in this configuration. The left and the right gloves 202, 204 are nested, that is, the left and the right gloves are not individually separable while folded. According to some embodiments, the glove pair 200 is folded in alternate quad-fold configurations comprising a double gate fold, or an accordion fold, as generally known in the art, for example, after folding the gloves as shown in FIG. 2C.

Figure 3:
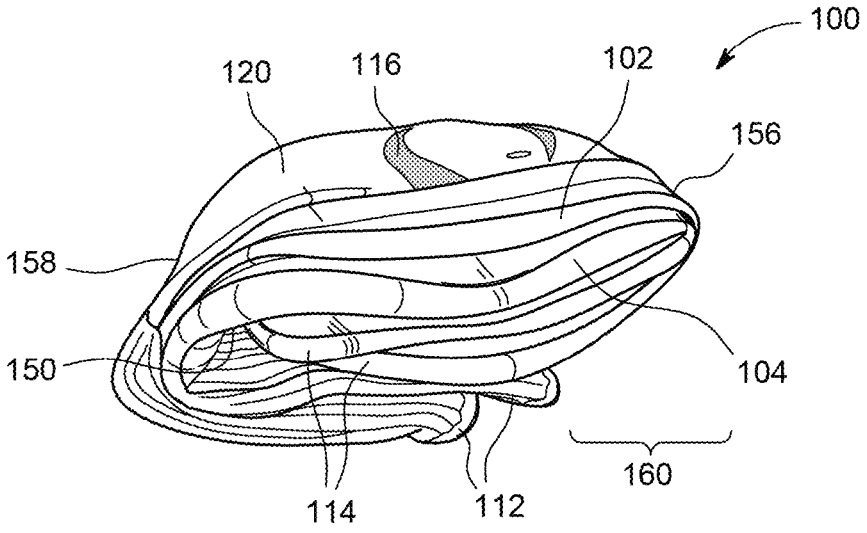
FIG. 3 depicts a perspective view of a pair of gloves folded in a tri-fold configuration, according to embodiments of the present invention.

Further details of glove pairs in exemplary folded configurations, and packaging thereof are described with respect to FIGS. 3-8. FIG. 3 depicts a perspective view of a pair of gloves 100 folded in a tri-fold configuration, according to embodiments of the present invention. The pair of gloves 100 includes two gloves, one each corresponding to a right hand 102 and a left hand 104. Within the present application, the left hand glove 104 or the right hand glove 102 are referred to without distinction, unless required by the context or otherwise indicated. The individual gloves within a pair are configured in a mirror configuration, that is, corresponding parts of the right hand glove are positioned to overlap with the corresponding parts of the left hand glove. This configuration is also referred to as a palm facing configuration, in which the palm of left hand glove overlaps the palm of right hand glove, while the backhand of both the left hand gloves are visible. In a palm facing a backhand configuration (not shown), the backhand of the left hand glove overlaps the palm of the right hand glove. It is noted that the glove pair includes two palms, two backhands, two cuffs, two sets of four fingers and two thumbs, and in the present application, any of these parts may be referred to without distinction, unless otherwise indicated.

The tri-fold configuration illustrated in FIG. 3 is a roll fold, such that fingers 114 and thumbs (not shown) are folded over backhand 118 of the left glove 104. The fold of the fingers 114 creates the edge 156, and cuffs 112 are folded over the fingers 112 creating the edge 158, individually referred to as the finger side edge 156 and the cuff side edge 158, respectively, and collectively referred to as the fold edges 156, 158. The folded fingers 114 extend towards the opposite cuff side edge 158, while the folded cuffs 112 extend towards the finger side edge 156. The folded fingers 114 extend fully to the cuff side edge 158. The folded cuffs 112 do not fully extend to the finger side edge 156, creating an overhang portion 160 between the cuffs 112 and the finger side edge 156.

The backhand 120 of the glove 102 includes one or more indicia 116 for display. The visible portion of the backhand 120 of the glove provides appropriate and sufficient space for the indicia 116, to enable a user to instantly recognize a manufacturer or type of gloves from the indicia 116 while the glove is folded in the tri-fold configuration. The tri-fold configuration nests the gloves 102, 104 into a secure packaging configuration and prevents the unintentional un-nesting of the right glove 102 and the left glove 104 while being removed from its packaging.

Figure 4:
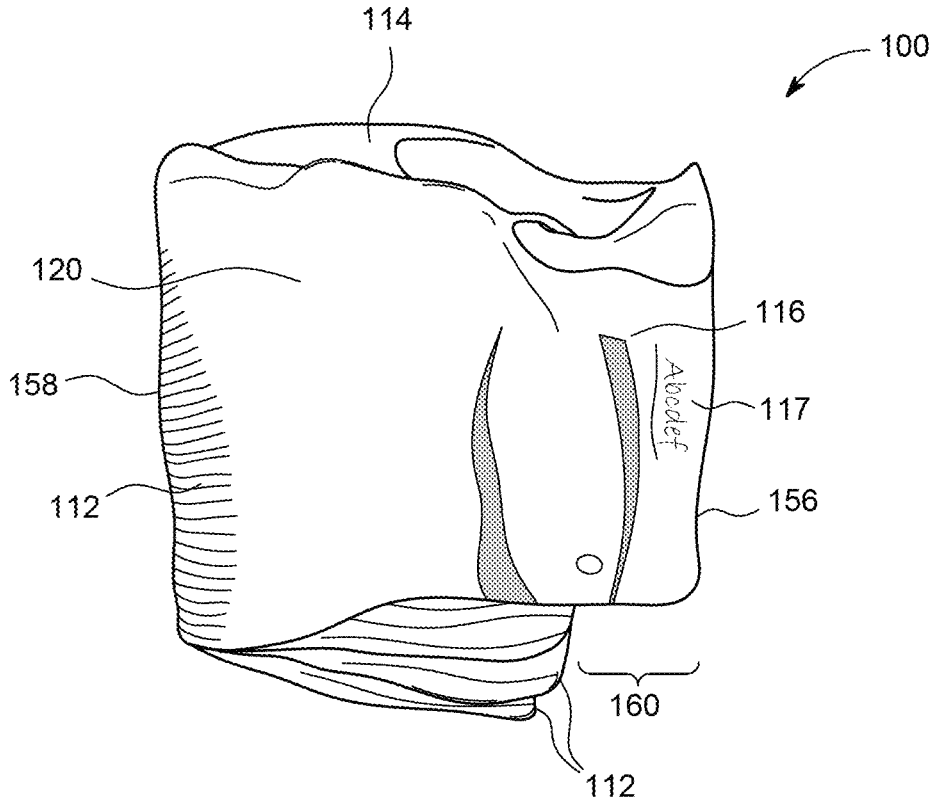
FIG. 4 depicts a top view of the pair of gloves of FIG. 3 folded in a tri-fold configuration, according to embodiments of the present invention.
Figure 5:
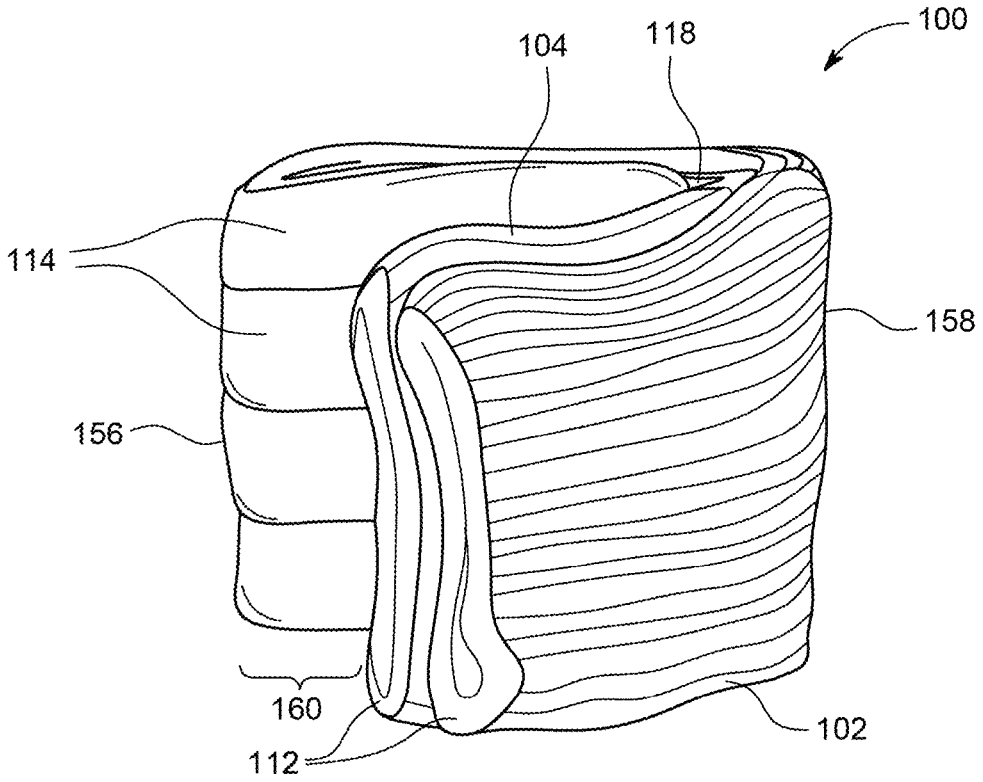
FIG. 5 depicts a bottom view of the pair of gloves of FIG. 3 folded in a tri-fold configuration, according to embodiments of the present invention.
Figure 6:
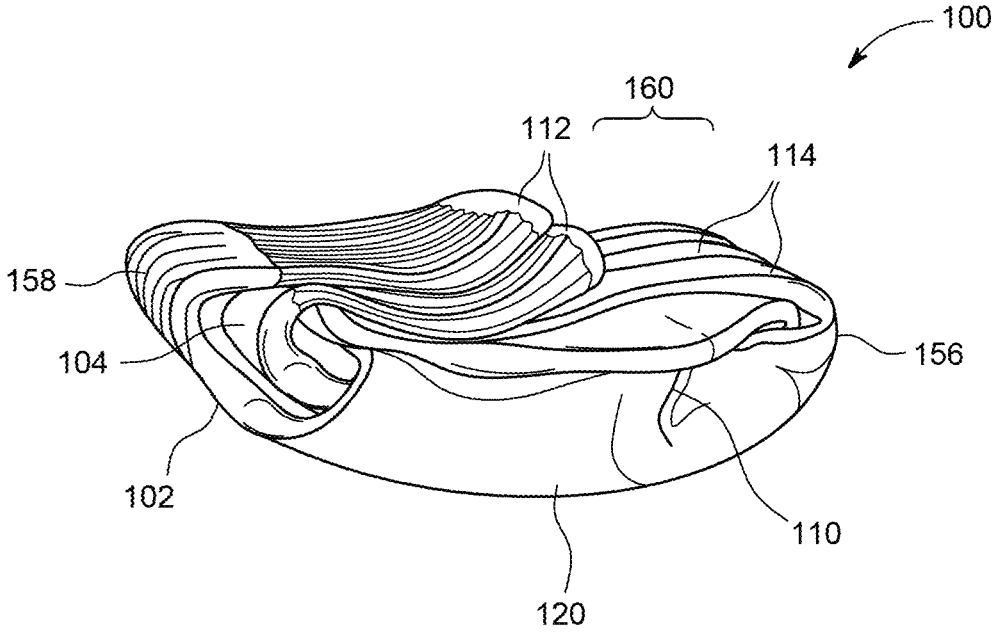
FIG. 6 depicts a side view of the pair of gloves of FIG. 3 folded in a tri-fold configuration, according to embodiments of the present invention.

FIG. 4 depicts a top view of the pair of gloves 100 of FIG. 3 folded in a tri-fold configuration, according to embodiments of the present invention. The indicia 116 further include, text marks 117, for example. FIG. 5 depicts a bottom view of the pair of gloves 100 of FIG. 3 folded in a tri-fold configuration, according to embodiments of the present invention. The folded pair of gloves 100 includes fingers 114 folded over the backhand 118. FIG. 6 depicts a side view of the pair of gloves 100 of FIG. 3 folded in a tri-fold configuration, according to embodiments of the invention. Thumbs 110 are folded in between fingers 114 and the backhand 118 of the left glove 104, as discussed above.

Figure 7:
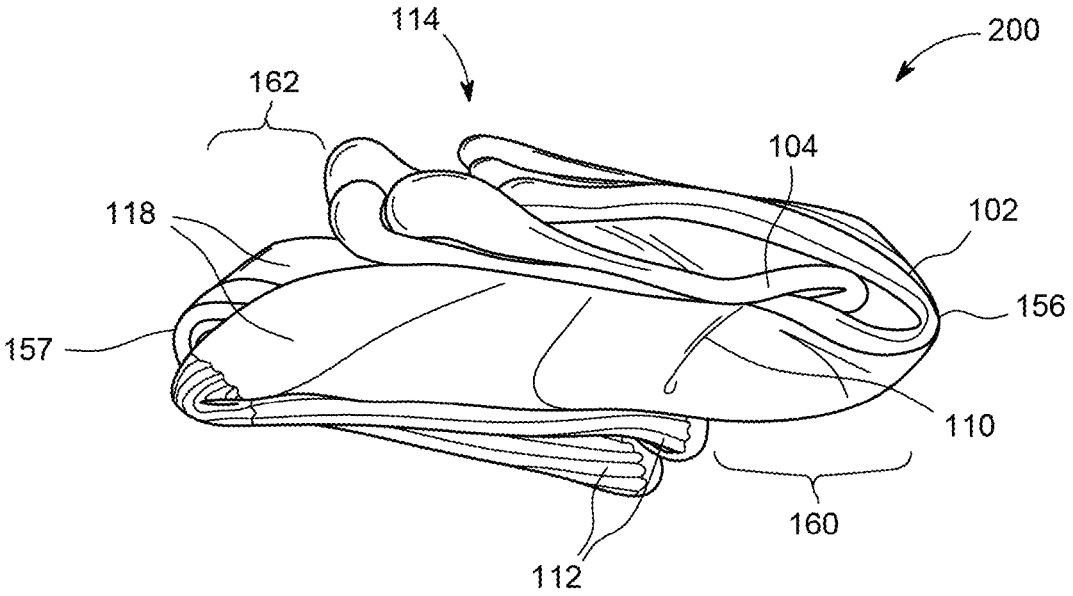
FIG. 7 depicts a side view of the pair of gloves in an alternate tri-fold configuration, according to embodiments of the invention.
Figure 8:
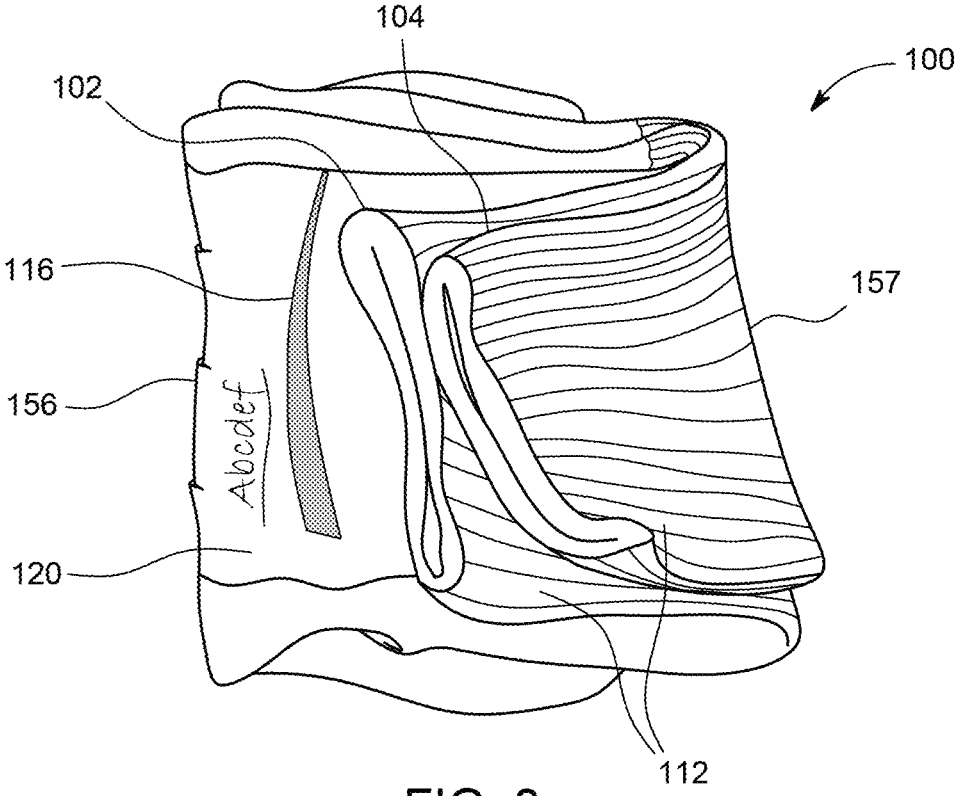
FIG. 8 depicts a top view of pair of gloves in the alternate tri-fold configuration of FIG. 7, according to embodiments of the invention.

FIG. 7 depicts a side view of the pair of gloves 100 in an alternate tri-fold configuration, according to embodiments of the invention. The tri-fold is a Z-shaped fold, such that the fingers 114 and the thumbs 110 are folded over the backhand 118 creating the edge 156, and cuffs 112 are folded over the backhand 120 of the right glove 102 creating the edge 157. Also, the thumbs 110 are folded onto the backhand 118, and the fingers 114 are folded over the thumbs 110 and the backhand 118, in other embodiments (not shown), the fingers 114 are folded over the backhand 118, and the thumbs 110 are folded over the fingers 114. The cuffs 112 are folded over the backhand 120 of the right glove 102. The cuffs 112 do not fully extend to the finger side edge 156 which is opposite the cuffs 112, creating a first overhang portion 160 between the folded cuffs 112 and the finger side edge 156. The fingers 114 are folded such that the folded fingers 114 do not fully extend to the cuff side edge 157, which is opposite the folded fingers 114, creating a second overhang portion 162 between the fingers 114 and the cuff side edge 157. FIG. 8 depicts a top view of the pair of gloves 100 in the alternate tri-fold configuration of FIG. 7, according to embodiments of the invention. The backhand 120 of the glove 102 includes indicia 116, such as patterns, for example, logos, marks, text 117 and the like, which are visible in the tri-folded configuration.

The tri-folded glove pair 100, tri-folded in either the roll fold or the Z-shaped fold configuration, as described with respect to FIGS. 3-8 can be packaged in, for example, partially or substantially transparent packaging (not shown) to allow visibility of the indicia 116 and the gloves 100, while constraining the volume occupied by the gloves 100. The packaging is made from polyethylene or similar transparent packaging materials, as are well known in the art.

Figure 9:
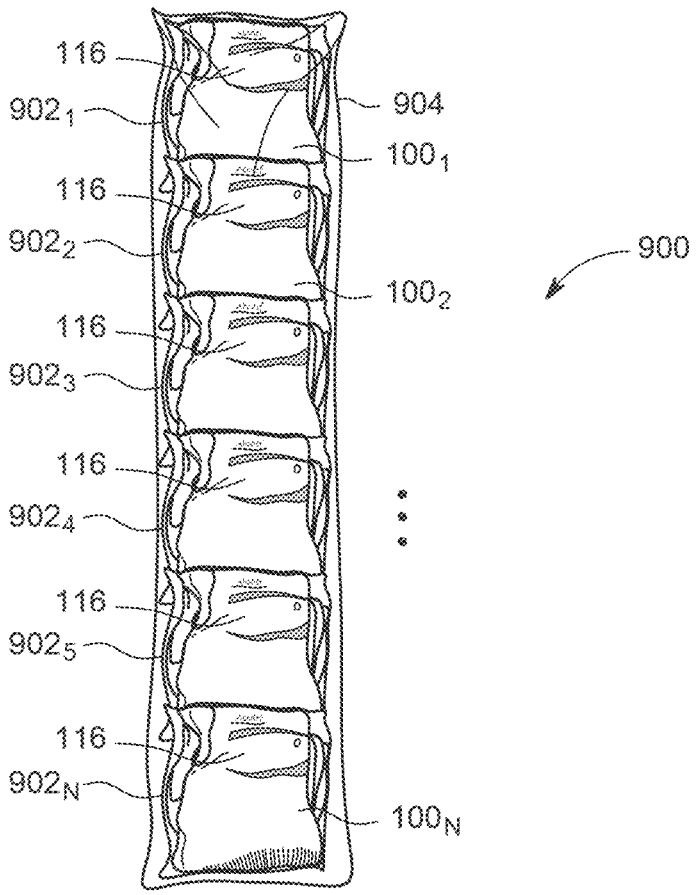
FIG. 9 depicts a first pair of packaged gloves, a second pair of packaged gloves, and a plurality of packaged pairs of gloves disposed therebetween, according to embodiments of the invention.

FIG. 9 depicts multiple packaged glove pairs 100, according to embodiments of the invention. Individual tri-folded glove pairs $\mathbf{100}_1$, $\mathbf{100}_2$ . . . $\mathbf{100}_N$ are packaged in individual first packaging $\mathbf{902}_1$, $\mathbf{902}_2$ . . . $\mathbf{902}_N$. The first packaging 902 tightly encases the glove pairs 100 in a tight manner, such that the first packaging 902 maintains the shape and the multi-fold configuration of the folded glove pairs 100, preventing the unfolding of the glove pairs 100 while packaged. According to some embodiments, the packaging 902 is shrink-wrapped over the glove pairs 100. Multiple pairs of gloves 100 packaged in first packaging 902 are further packaged in an outer second packaging 904. The indicia 116 of gloves 100 are visible through the first packaging 902 and through the second packaging 904.

Figure 10:
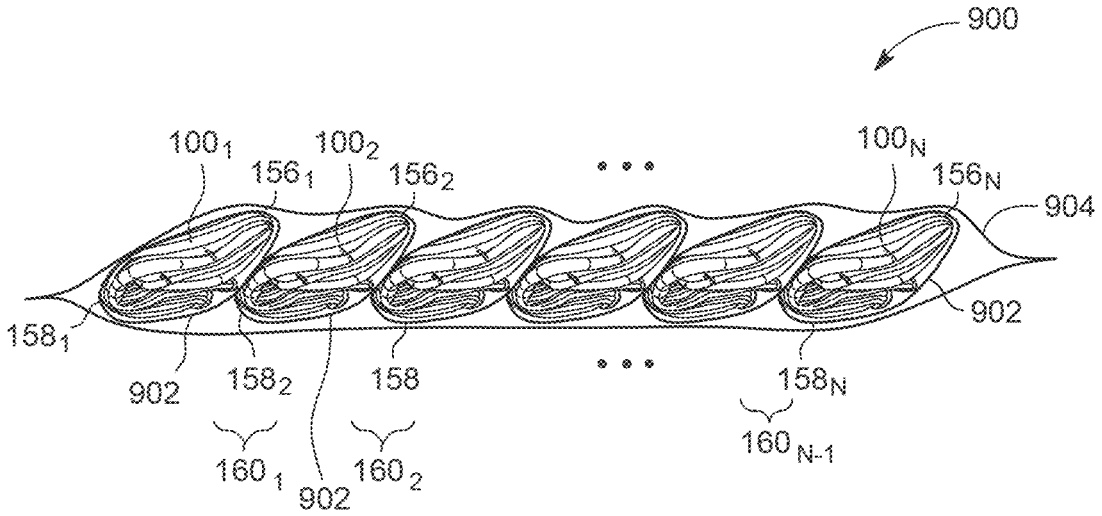
FIG. 10 depicts a side view of the packaged glove pairs of FIG. 9, according to embodiments of the invention.

FIG. 10 depicts a side view of the packaged glove pairs $\mathbf{100}_1$, $\mathbf{100}_2$ . . . $\mathbf{100}_N$ of FIG. 9, according to embodiments of the invention. First packaged glove pair $\mathbf{100}_1$ and second packaged glove pair $\mathbf{100}_2$ overlap such that the edge $\mathbf{158}_2$ of the glove pair $100_2$ lies under the overhang portion $160_1$ of the first packaged glove pair $100_1$. Therefore, the first packaged glove pair $100_1$ overlaps a portion of the second packaged glove pair $100_2$ within the overhang portion $160_1$ of the first packaged glove pair $100_1$. Advantageously, the packaging 902 allows for the overhang portion $160_1$ to be prominent available to accommodate the edge $158_2$ of the glove pair $100_2$. The packaging configuration described is referred to as an overlap packaging configuration. According to several embodiments, use of such overhang portions of a glove pair to accommodate portions of another glove pair provides volume efficient packaging, which is advantageous for transportation and for display and dispense in vending machines, without compromising on the visibility of the indicia 116, for example. While volume efficient packaging has been illustrated by use of overlap 160, it should be noted that any fold that comprises an overhang, such as overhang 160 or 162, allows for an overlap packaging configuration, in a manner similar to that described above. Such configurations will occur to those skilled in the art without departing from the scope and the spirit of the present invention.

Figure 11:
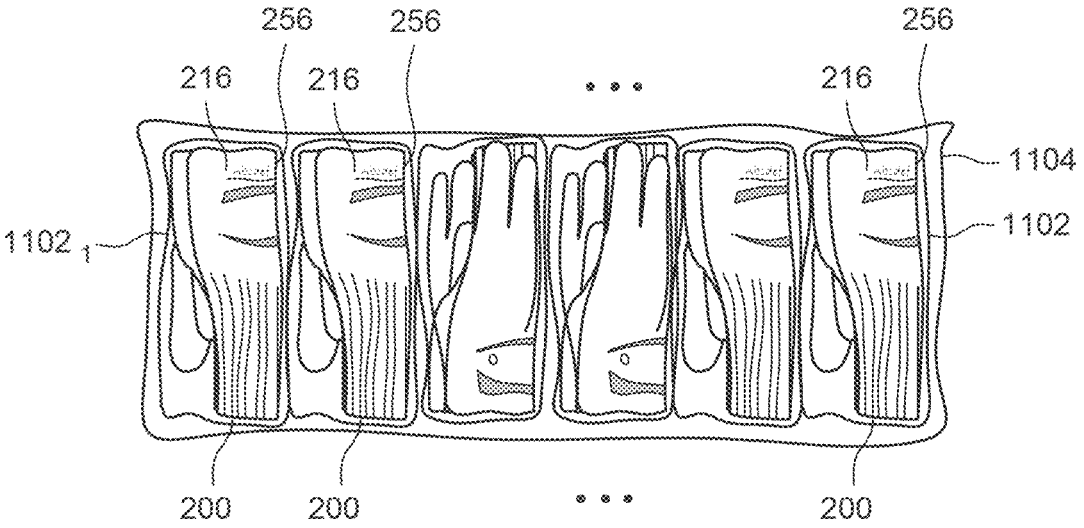
FIG. 11 depicts a first pair of packaged gloves, a second pair of package gloves, and plurality of pairs of packaged gloves disposed therebetween, according to embodiments of the invention.

FIG. 11 depicts a first pair of packaged gloves $200_1$, a second pair of package gloves $200_N$, and plurality of pairs of packaged gloves disposed therebetween, according to embodiments of the invention. Individual quad-folded glove pairs 200, as discussed with respect to FIGS. 2A-2D, are packaged in individual first packaging 1102. The first packaging 1102 encases the glove pairs 200 in a tight manner, such that the first packaging 1102 maintains the shape and the fold configuration of the glove pairs 200, and prevents unfolding of the glove pairs 200 while packaged. According to some embodiments, the packaging 1102 is shrink-wrapped over the glove pairs 200. Multiple pairs of such gloves 200 packaged in individual packaging $1102_1$, $1102_2$ . . . $1102_N$, are further packaged in an outer second packaging 1104. At least a part of the indicia 216 of gloves 200 are visible through the first packaging 1102 and through the second packaging 1104. According to several embodiments, adjacent pairs of glove pairs 200 are turned upside down, such that if a top of a glove pair $200_2$ and bottom of glove pair $200_3$ is visible. In this configuration, at least a part of the indicia 216 is visible from both sides of the packaging 1104. Such folding configuration provides for volume efficient packaging and is also advantageous for display and dispense in vending machines, while ensuring visibility of at least a part of the indicia 216 from both sides of the glove pairs 200.

Figure 12:
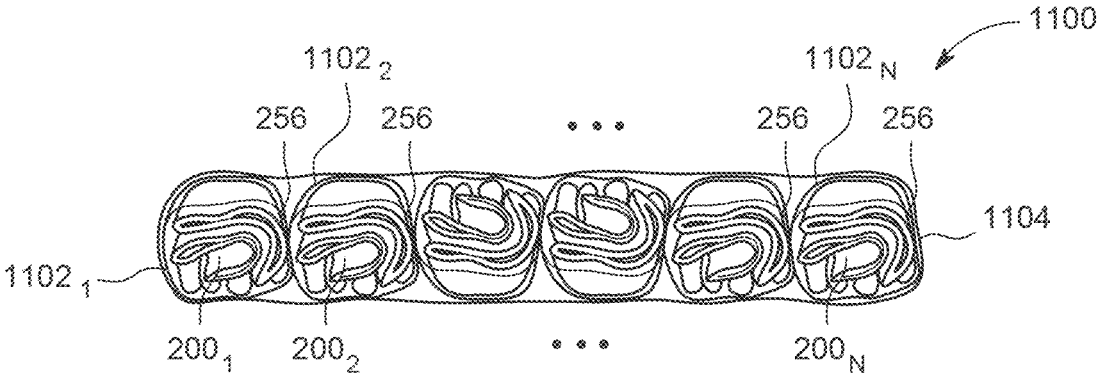
FIG. 12 depicts a side view of the packaged glove pairs of FIG. 11, according to embodiments of the invention.

FIG. 12 depicts a side view of the packaged glove pairs 200 of FIG. 11, according to embodiments of the invention. Glove pairs $200_1$, $200_2$ are laid adjacent such that the edge 256 of the glove pair $200_1$ lies next to an edge opposite to the edge 256 of the glove pair $200_2$.

Figure 13:
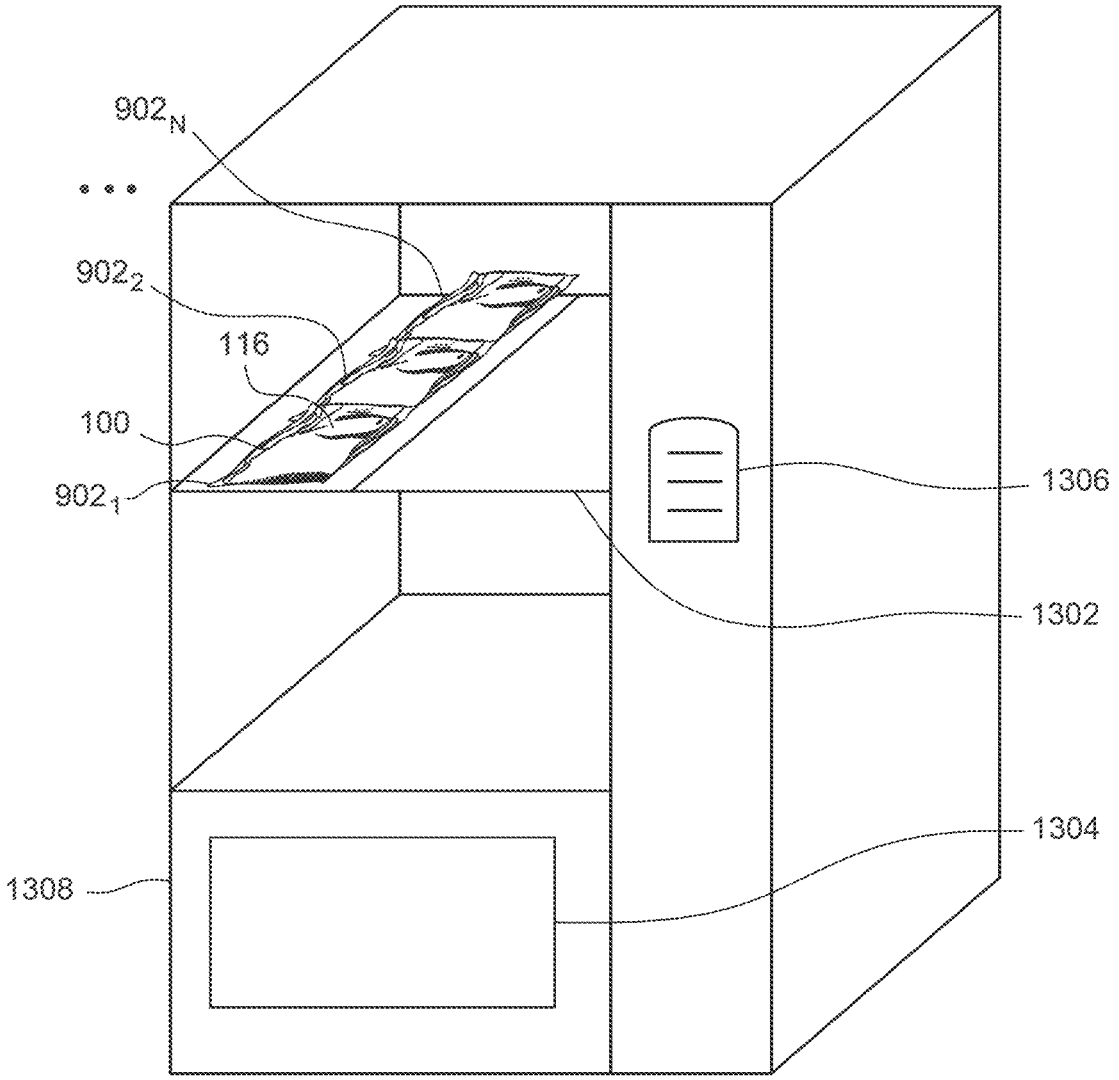
FIG. 13 depicts a vending machine comprising several pairs of individually packaged tri-folded gloves, according to embodiments of the invention.

FIG. 13 depicts a vending machine 1300 comprising several pairs of individually packaged tri-folded pair of gloves 100, according to embodiments of the invention. The vending machine 1300 comprises trays 1302 for displaying products that are dispensed to a collection tray 1304 by use of user interface 1306. The pair of gloves $100_1$ or $100_2$ are visible through a display area 1308, typically a transparent window that securely displays the products in the vending machine 1300. According to several embodiments, the vending machine 1300 stores individual glove pairs 100 with packaging 902, for display and dispense, using the vending machine 1300. Advantageously, in addition to being volume efficient, the tightly wound packaging 902 prevents accidental unfolding of the folded gloves pairs 100, or a significant change in shape of the folded glove pairs 100, thereby preventing jamming of the vending machine 1300. The glove pairs 100 are efficiently stored, and have the indicia 116, which is visible from outside the vending machine 1300 through the display area 1308, for appropriate selection by a consumer who wishes to extract a glove pair using the vending machine 1300. Any of the several vending machines as generally known in the art may be deployed for dispensing the glove pairs 100, or the glove pairs 200.

Figure 14:
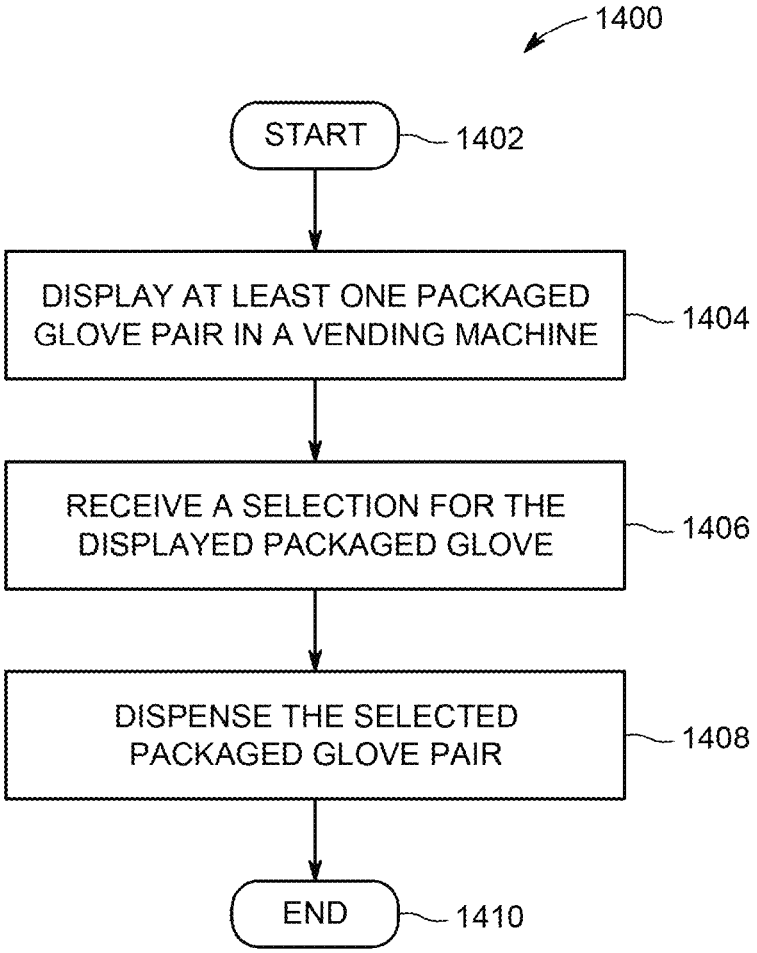
FIG. 14 depicts a method for vending a packaged glove pair using the vending machine of FIG. 13, according to embodiments of the invention.

FIG. 14 depicts a method 1400 for vending a packaged glove pair using the vending machine 1300 of FIG. 13, according to embodiments of the invention. At least some steps of the method 1400 are implemented using a microcontroller or microprocessor based digital computing device, or other digital computing electronic device deployed in vending machines, as generally known in the art. The method 1400 starts at step 1402 and proceeds to step 1404, at which the method 1400 displays at least one packaged glove pair in a vending machine. For example, the vending machine 1300 displays, to a user of the vending machine 1300, the glove pair 100 tightly encased in the packaging 902. The method 1400 proceeds to step 1406, at which the method 1406 receives a selection for the displayed packaged glove. For example, the user of the vending machine 1300 views the displayed glove, and selects the desired product. At step 1408, the method 1400 dispenses the selected packaged glove pair. The method 1400 proceeds to step 1410, where the method 1400 ends.

Although only a few exemplary embodiments of the present invention have been described in detail above, those skilled in the art will readily appreciate that many modifications are possible in the exemplary embodiments without materially departing from the novel teachings and advantages of this invention. For example, while multiple folds have been explained with respect to tri-folds, similarly configured quad-folds will occur readily to those skilled in the art without departing from the scope and spirit of the present invention. Further, wherever possible, the left hand gloves and the right hand gloves may be reversed without departing from the scope and spirit of the present invention. While the embodiments are discussed herein with respect to palm facing configuration, those skilled in the art will appreciate that the embodiments are not restricted by the palm facing configuration, but rather extend to several other configurations discussed herein or that will occur readily to those skilled in the art without departing from the scope and spirit of the present invention.

Publications and references, including but not limited to patents and patent applications, if cited in this specification are herein incorporated by reference in their entirety and cited as if each individual publication or reference were specifically and individually indicated to be incorporated by reference herein as being fully set forth.

The foregoing description of embodiments of the invention comprises a number of elements, devices, machines, components and/or assemblies that perform various functions as described. These elements, devices, machines, components and/or assemblies are exemplary implementations of means for performing their respectively described functions. While the foregoing is directed to embodiments of the present invention, other and further embodiments of the invention may be devised without departing from the basic scope thereof.

What is claimed is:

1. A package for one glove pair, comprising:

a right glove and a left glove, each glove comprising fingers, a palm and a cuff, the right glove and the left glove are arranged in parallel adjacent to and overlapping each other, and the fingers of the right glove are aligned with the fingers of the left glove, forming a glove pair, at least one glove of the glove pair having an indicia comprising at least one of a logo, a pattern, a mark, or text displayed thereon, and the glove pair having a tri-folded state, wherein the tri-folded state comprises either at least a portion of the fingers folded over and adjacent to and contacting the palm and at least a portion of the cuff folded over and adjacent to the fingers to form an S-fold, or at least a portion of the cuff folded over and adjacent to and contacting the palm and at least a portion of the fingers folded over and adjacent to the cuff to form a S-fold; and an at least partially transparent packaging fully encasing the folded glove pair, the packaging being compliant with the shape of the folded glove pair and the packaging maintaining the folded glove pair in the tri-folded state, and at least one of the logo, the pattern, the mark, or the text of the indicia being visible through the packaging while the folded glove pair is fully encased within the packaging.

2. The package of claim 1, wherein at least one of the folded fingers or the folded cuffs of the packaged folded glove pair do not extend fully to a cuff side edge or a finger side edge, respectively, creating at least one overhang portion of the folded glove pair, wherein the folded fingers overhangs the cuff side edge, or the folded cuffs overhang the finger side edge.

3. The package of claim 1, wherein the packaging is polyethylene packaging.

4. The package of claim 1, wherein the packaging is sized for display and dispensing from a vending machine.

5. The package of claim 1, wherein the indicia is completely visible through the packaging.

6. The package of claim 1, wherein the indicia is located on a backhand side of the glove, opposite the palm.

7. The package of claim 6, wherein the indicia is visible when the package is displayed in a vending machine.

8. The package of claim 1, wherein the packaging is a shrink-wrap packaging.

9. A folded glove pair package, comprising:

a glove pair comprising one right glove and one left glove, each comprising fingers, a palm and a cuff, the right glove and the left glove are arranged facing in an overlap and adjacent to each other, and the fingers of the right glove are aligned with the fingers of the left glove, at least one glove of the glove pair having an indicia comprising at least one of a logo, a pattern, a mark, or text displayed thereon, and the glove pair having a folded state comprising one of:

at least a portion of the fingers folded over and adjacent to and contacting the palm and at least a portion of the cuff folded over and adjacent to the fingers, at least a portion of the cuff folded over and adjacent to and contacting the palm and at least a portion of the fingers folded over and adjacent to the cuff, or at least a portion of the fingers folded over and adjacent to the palm on a first side and at least a portion of the cuff folded over and adjacent to the palm on a second side opposite the first side; and an at least partially transparent packaging tightly encasing the folded glove pair, the packaging being compliant with the shape of the folded glove pair and the packaging maintaining the folded glove pair in the folded state, and at least one of the logo, the pattern, the mark, or the text of the indicia being visible through the packaging while the folded glove pair is encased in the packaging.

10. The package of claim 9, wherein at least one of the folded fingers or the folded cuffs of the folded glove pair do not extend fully to a cuff side edge or a finger side edge, respectively, creating at least one overhang portion of the folded glove pair, the at least one overhang portion comprising the folded fingers overhanging the cuff side edge, the folded cuffs overhanging the finger side edge, or both, the at least one overhang portion has thickness less than the maximum thickness of the of the folded glove pair.

11. The package of claim 10, wherein the at least one overhang portion allows for accommodating another package of a folded glove pair.

* * * * *